US011083219B2

(12) United States Patent
Van Lancker et al.

(10) Patent No.: US 11,083,219 B2
(45) Date of Patent: Aug. 10, 2021

(54) COLLAPSIBLE TOBACCO CONTAINER

(71) Applicant: PHILIP MORRIS PRODUCTS S.A., Neuchatel (CH)

(72) Inventors: Pieter Van Lancker, Merelbeke (BE); Bart Bruggeman, Bornem (BE); Thomas Valcke, Kortrijk (BE)

(73) Assignee: Philip Morris Products S.A., Neuchatel (CH)

( * ) Notice: Subject to any disclaimer, the term of this patent is extended or adjusted under 35 U.S.C. 154(b) by 164 days.

(21) Appl. No.: 16/307,864

(22) PCT Filed: Jun. 28, 2017

(86) PCT No.: PCT/IB2017/053876
§ 371 (c)(1),
(2) Date: Dec. 6, 2018

(87) PCT Pub. No.: WO2018/007903
PCT Pub. Date: Jan. 11, 2018

(65) Prior Publication Data

US 2019/0289907 A1 Sep. 26, 2019

(30) Foreign Application Priority Data

Jul. 4, 2016 (EP) ..... 16177819

(51) Int. Cl.
*A24F 23/02* (2006.01)
*B65D 30/20* (2006.01)
*B65D 33/25* (2006.01)

(52) U.S. Cl.
CPC ..... *A24F 23/02* (2013.01); *B65D 31/10* (2013.01); *B65D 33/2591* (2013.01)

(58) Field of Classification Search
CPC ..... A24F 23/02; A24F 23/04; B65D 33/2591; B65D 31/10

(Continued)

(56) References Cited

U.S. PATENT DOCUMENTS 5,161,731 A * 11/1992 Rivlin ..... B42F 7/00 229/67.3
6,213,645 B1 4/2001 Beer
6,467,956 B1 * 10/2002 Tilman ..... B65D 33/2591 383/104

(Continued)

FOREIGN PATENT DOCUMENTS

CA 2599227 A1 6/2008
CN 1283529 C 3/2005

(Continued)

OTHER PUBLICATIONS

Extended European Search Report, issued by the European Patent Office for EP 16177819.6, dated Feb. 3, 2017; 8 pgs.

(Continued)

*Primary Examiner* — Steven A. Reynolds
(74) *Attorney, Agent, or Firm* — Mueting Raasch Group

(57) ABSTRACT

A container includes a front wall, a back wall, first and second opposing sidewalls, a foldable top, and a bottom. An interior for storing consumer goods is defined between the front wall, the back wall, the first and second side walls, the top and the bottom. Each side wall has three or more fold lines, which form two or more indents extending along the side wall from the bottom to the top. The fold lines of the first side wall are aligned with the fold lines of the second side wall. The container is expandable and collapsible such that the distance between the front wall and the back wall increases as the container is expanded and decreases as the container is collapsed. The top forms a fin when the top is unfolded.

14 Claims, 4 Drawing Sheets

(58) Field of Classification Search
USPC ..... 206/260, 242; 383/104, 120
See application file for complete search history.

(56) References Cited

U.S. PATENT DOCUMENTS

| | | | | |
|---|---|---|---|---|
| 2003/0081864 | A1* | 5/2003 | Baker | B65D 33/34 383/204 |
| 2004/0208400 | A1 | 10/2004 | Linneweil | |
| 2005/0103798 | A1 | 5/2005 | Luigi | |
| 2005/0244083 | A1 | 11/2005 | McMahon et al. | |
| 2007/0036473 | A1 | 2/2007 | Nagata et al. | |
| 2007/0092167 | A1 | 4/2007 | Tilman et al. | |
| 2008/0053864 | A1* | 3/2008 | Nonas | A45C 11/20 206/549 |
| 2008/0152264 | A1* | 6/2008 | Pokusa | B65D 75/5805 383/5 |
| 2009/0152161 | A1* | 6/2009 | St. Cyr | A45C 11/00 206/581 |
| 2009/0317021 | A1* | 12/2009 | Taylor | B62B 3/1464 383/6 |

FOREIGN PATENT DOCUMENTS

| | | | |
|---|---|---|---|
| CN | 1911742 | A | 2/2007 |
| CN | 101087718 | A | 12/2007 |
| CN | 201665353 | U | 12/2010 |
| CN | 204528004 | U | 8/2015 |
| CN | 105129212 | A | 12/2015 |
| DE | 9218098 | U1 | 9/1993 |
| EP | 1321381 | A1 | 6/2003 |
| GB | 432 178 | A | 7/1935 |
| GB | 1 454 695 | A | 11/1976 |
| GB | 2 199 489 | A | 7/1988 |
| GB | 2451752 | A | 2/2009 |
| JP | S51148314 | U | 11/1976 |
| JP | H10147365 | A | 6/1998 |
| WO | WO 2004/026704 | A2 | 4/2004 |
| WO | WO 2006/068523 | A1 | 6/2006 |
| WO | WO 2016/025823 | A1 | 2/2016 |

OTHER PUBLICATIONS

International Search Report and Written Opinion for PCT/IB2017/053876, issued by the European Patent Office, dated Nov. 3, 2017; 14 pgs.

Chinese Office Action for CN Application No. 201780035414.X, issued by the Chinese National Intellectual Property Administration, Mar. 22, 2021; 21 pgs. including English translation.

* cited by examiner

COLLAPSIBLE TOBACCO CONTAINER

This application is the § 371 U.S. National Stage of International Application No. PCT/IB2017/053876, filed 28 Jun. 2017, which claims the benefit of European Application No. 16177819.6, filed 4 Jul. 2016.

This disclosure relates to collapsible tobacco containers, such as multi-compartment stand-up bags having resealable tops.

Handmade cigarettes are made, usually by the smoker, by wrapping a rectangular sheet of cigarette paper of the length of the cigarette around loose tobacco. Cigarette papers for hand making may have a moisture activated adhesive strip along one long edge and are usually presented in a small package from which one paper protrudes through a slot. The papers are typically folded longitudinally and interleaved inside the packet so that removal of the protruding paper causes the next paper to protrude through the slot. The wrapping is often done by hand, by use of a cigarette rolling mat, or by use of a small hand operated machine. The handmade cigarette may optionally include a filter according to the smoker's preference.

Tobacco for handmade cigarettes is often supplied in pouch-style containers. Once the pouch is opened, the tobacco may begin to lose moisture and dry out. Some tobacco pouches are made from a flexible plastic film and have a flap that may be lifted to reveal an opening in the film for access to the tobacco. Some pouches may be resealable to maintain freshness of the tobacco or to prevent the tobacco from spilling out of the pouch. For example, some tobacco pouches are provided with a freshness seal that can be broken open or are provided with a plastic zip at the opening that is resealable.

A consumer of 'roll your own' or 'make your own' cigarettes requires tobacco, cigarette papers and, optionally, filters. The paper and filters may be carried separately from the tobacco, but this can be inconvenient and may result in one of the components being mislaid by the consumer. If papers or filters are placed in the pouch with the tobacco, they can become mixed up with the tobacco and may be hard to find when required. In addition, the relatively high moisture level in tobacco can cause the papers to become damp and the adhesive may be activated so that the papers in the packet of papers adhere to one another, making them inconvenient or impossible to use.

It would be desirable to provide a simple tobacco container that stores a quantity of loose tobacco, and optionally tobacco accessories, sufficient to make multiple handmade cigarettes. It would be desirable to limit the transfer of moisture to and from the tobacco. It would also be desirable to provide a stable opening to facilitate easy access to the tobacco and to mitigate accidental spills.

Containers of the present invention may be useful for storing tobacco, for storing tobacco and one or more suitable accessory such as one or both of cigarette paper and filters, or for storing any other suitable consumer good. Preferably, containers of the invention are used for storing tobacco-related products, such as tobacco or tobacco assessories. Preferably, the containers are stand-up bags.

A container for one or more consumer goods of the present invention comprises a front wall, a back wall, first and second opposing sidewalls, a foldable top and a bottom. An interior for storing the consumer goods is defined between the front wall, the back wall, the first and second side walls, the top and the bottom. Each side wall comprises three or more fold lines, which form two or more indents, extending along each side wall from the bottom to the top.

The fold lines of the first side wall are aligned with the fold lines of the second side wall. The container is expandable and collapsible such that the distance between the front wall and the back wall increases as the container is expanded and decreases as the container is collapsed. The top forms a fin when the top is unfolded. The top comprises a first face extending from the front wall and a second face extending from the back wall. A portion of an inner surface of the first face and a portion of an inner surface of the second face contact to form the fin. When the top is folded down, the first and second faces of the top are substantially parallel to the bottom and the fin is substantially flat against one of the first face or the second face of the top. When the top is folded down and the container is expanded, the container has a rectangular shape. Preferably, the container is a stand-up bag.

The containers of the invention may be simple to use. For example, the containers may be easy to open and close and provide for easy access to consumer goods stored in the container. The container may include a sealing element, such as a zip sealing assembly, configured to seal the container in the region of the fin.

The containers may have any suitable number of compartments within the interior of the container. The compartments may allow for separating one or more components stored within the containers. For example, tobacco may be stored in a compartment separate from a tobacco accessory, such as cigarette paper. Different types of tobacco, such as different varieties of flavored tobacco or different blends of tobacco, may be stored in different compartments. At least some of the compartments may be resealable, which may prevent accidental mixing of tobacco or another consumer good stored in one compartment with material stored in another compartment. Resealable compartments may also maintain freshness of the tobacco or the another consumer good stored in the compartment and may reduce indirect effects, such as transfer of moisture or volatile flavor compounds, of material stored in one compartment on material stored in another compartment. For example, multi-compartment containers of the invention may allow cigarette paper (also referred to as rolling paper) or filters, or both, to be carried in the container separately from tobacco, which may prevent the cigarette papers or filters from becoming mixed up with the tobacco and may reduce the effects of moisture from the tobacco on the cigarette paper or filters. In addition, because the compartments may be sealed, the consumer may open a first compartment and consume the tobacco in the first compartment, while other tobacco compartments remain sealed to preserve freshness.

The size of the compartments may be tailored to suit the material stored within each compartment. For example, the compartments may be of the same or varying size.

A container of the present invention is preferably a stand-up bag. As used herein, a "bag" is a container made of flexible material with an opening at the top. The folds of the side walls provide sufficient rigidity to allow the bag to stand upright and allow the bag to be collapsed in a predefined manner.

Preferably, the top of the container folds flat. When the top is folded and the container is expanded, the container preferably has a rectangular shape. The rectangular shape may allow for more efficient packing or stacking for shipping or storage of multiple containers of the invention that include consumer goods within the interior.

Preferably, the top, the bottom, the front wall, the back wall, and the sidewalls are formed from the same material. For example, they may be formed from a sheet of material.

The terms "upper," "lower," "side," "top," "bottom," and other terms are used to describe relative positions of the components or portions of a container. When describing a container according to the present invention, these terms are used irrespective of the orientation of the container being described. However, with reference to a stand-up bag, the bag is configured to stand upright on the bottom with the top being openable to allow access to the contents of the bag.

This disclosure relates to collapsible tobacco containers, such as multi-compartment stand-up bags having resealable tops. This disclosure also related to packaged consumer goods including a container of the invention and one or more consumer good stored in the container. Containers of the present invention comprise a front wall, a back wall, first and second opposing side walls, a foldable top and a bottom. The side walls each comprise three or more fold lines that form two or more indents in the side wall extending from the bottom to the top. The container is expandable and collapsible such that the distance between the front wall and the back wall increases as the container is expanded and decreases as the container is collapsed. The fold lines of the first side wall are aligned with the fold lines of the second side wall such that the side walls form an accordion or bellows type structure. The top forms a fin when the top is unfolded.

The fin of the top of the container may be formed from opposing faces. For example, a first face of the top may extend from the front wall of the container, and an opposing second face of the top may extend from the back wall of the container. A portion of an inner surface of the first face and a portion of the inner surface of the second face may contact to form the fin. Consumer goods in the interior of the container may be accessed by separating the first face from the second face in the region of the fin to create an opening to the interior.

Preferably, the container comprises a sealing element configured to seal the container in the region of the fin. Preferably, the sealing element is resealable. Any suitable sealing element may be used to seal or reseal the container in the region of the fin. For example, the sealing element may comprise a zip seal assembly that includes complementary elements on the inner surfaces of the first face of the top and of the second face of the top in the region of the fin. For example, the container may contain a Zip-Lock assembly in the region of the fin. And preferably, the sealing element is provided with a child-resistant lock for preventing children from accessing the contents inside the container.

The container may comprise any other suitable sealing element in the region of the fin. For example, the sealing element may comprise non-permanent adhesive, a microsuction structure, a loop and hook structure, magnetic elements, or the like.

Examples of suitable non-permanent adhesives include pressure sensitive adhesives. For example, the adhesive may include a low tack adhesive comprising a fast-curing acrylic oligomer (epoxidized soy bean oil acrylate), a slower-curing, reactive tack-control agent (urethane acrylate) and an optional elastomeric component (methacrylated polybutylene), commercially available from Mondelez International, for example.

A sealing element may include any suitable microsuction structure. The term "microsuction structure" is used herein to refer to an element comprising a flexible material having a plurality of micro cavities, microsuction cups or microbubbles on the material's external surface. The walls of the microsuction structure are deformable, such that, when the external surface of the material is pressed against a contact surface, a sealed environment of reduced pressure is formed between the walls of the cavities and the contact surface. This provides a suction force between the walls of the cavities and the contact surface. The microsuction structure may have a diameter of from about 5 microns to about 300 microns. The material forming the microsuction structure may be formed of an expanded resin having a plurality of internal air bubbles. The material may be provided as a layer of a sheet-like article on the surface of the container, such as an internal surface of a face of the top in the region of the fin. The layer may have a thickness of from about 30 microns to about 500 microns. The microsuction structure may be any microstructure that utilizes suction to form a seal. Microsuction structures are commercially available under the trade designation Yupo Tako from Yupo Europe GmbH.

A sealing element may include any suitable magnetic material and opposing magnetic material. The magnetic material may be one or more magnets forming the sealing element. In preferred embodiments, the sealing element is magnetic nanoparticles dispersed in a polymeric material. The polymeric material preferably is a light or heat curable polymeric adhesive. The magnetic nanoparticles preferably are magnetic metal or magnetic metal oxide nanoparticles. The magnetic metal may include iron, cobalt, nickel and alloys of iron, cobalt or nickel. The size of the nanoparticles may be about 1 nanometer to about 100 nanometres.

A sealing element may include any suitable hook and loop fastener. Hook and loop fasteners are commercially available from under the trade designation Velcro from Velcro GmbH.

Regardless of the sealing element employed, the sealing element preferably maintains the first and second faces of the top in a region of the fin in sufficiently close proximity to prevent consumer goods, such as tobacco, from accidentally spilling out of the container. The sealing element need not prevent fluid, such as air or moisture, transfer from outside the container to the interior of the container or from the interior of the container to outside the container. Preferably, the seal is sufficient to prevent or reduce the rate of moisture transfer between the outside of the container and the interior of the container to maintain freshness of the consumer goods, such as tobacco, maintained within the container. Preferably, the seal is sufficient to maintain the moisture level of the tobacco in the container.

Preferably a resealable sealing element is configured to allow opening and closing of an access opening at least about 5 times or at least about 10 times, or at least about 20 times or at least about 30 times. The term "reseal" refers to securely closing the access opening so that human force or action is required to open the resealable access opening.

When the top is unfolded, the fin may lie within a plane substantially parallel to the front and back walls of the container and between the front and back walls. Preferably, the plane in which the fin lies, when the top is unfolded, is midway between the front and back walls. The first face of the top may extend the top of the front wall of the container to the fin when the top is unfolded. The second face of the top may extend from the back wall of the container to the fin when the top is unfolded.

When the top is folded down, the fin is preferably substantially flat against at least a portion of the first or second face of the top.

When the container is fully expanded, a portion the first face of the top that extends from the front wall to the fin and a portion of the second face of the top that extends from the front wall to the fin preferably lie within a plane substantially parallel to the bottom of the container. In such embodiments and where the container is expanded, only the portion of the top that forms the fin needs to be folded down against the first or second face of the top to assume the folded configuration.

When the top is folded down, the container is preferably substantially rectangular, which may provide for efficient packing or stacking of multiple containers for shipping or storage. The substantially rectangular container may also provide a clean looking appearance.

The top may be maintained in a folded down position prior to shipping a packaged consumer good comprising the container and one or more consumer good in the container. The top may be maintained in the folded down position in any suitable manner. For example, a portion of the top may be temporarily adhered to an edge the front or back wall or may be temporarily adhered to itself. For example, a portion of the fin may be temporarily adhered to an outer surface of the first or second face of the top. The fin portion may be lifted to unfold the top and detach the fin from the outer surface of the face to which it is adhered.

Alternatively, a resealable label may be used to maintain the top in the folded down position. For example, the resealable label may be affixed to the front wall, extend across the folded down top and be affixed to the back wall. Alternatively, the label may be affixed to the front or back wall and to a portion of the folded down top to maintain the top in the folded configuration. The label may be broken by the consumer to unfold the top and allow access to the contents of the container by separating the first and second faces forming the fin. The label may allow for visual inspection by the consumer for evidence of tampering. That is, a broken label may be indicative of tampering.

The side walls of containers of the invention each comprises three or more fold lines that form two or more indents in the side wall extending from the bottom to the top. The container is expandable and collapsible such that the distance between the front wall and the back wall increases as the package is expanded and decreases as the package is collapsed. The fold lines of the first side wall are aligned with the fold lines of the second side wall such that the side walls form an accordion or bellows type structure.

A fold line of the first side wall is aligned with a fold line of the second side wall if the fold lines on the opposing side walls fall in a plane generally parallel to the front wall or back wall when the container is expanded. Preferably, the container is configured such that the fold lines of the first and second side wall are biased towards being aligned throughout a process of expanding and collapsing of the container.

As used herein a "fold line" refers to a line about which material, in which the line is formed, folds. A "fold line" may be formed by folding the material about the line, may be a crease line, a score line or any other line about which the material is configured to fold.

As the container is collapsed, indents form or are augmented along the fold lines in the side walls to facilitate structured collapse of the container. The side walls may contain any number of three of more fold lines configured to cause any number of two or more indents to form as the container is collapsed. For example, the side walls may include four, five, six or more fold lines that form three, four, five or more indents. Preferably, the material forming the side wall is folded back on itself several times when the container is collapsed, and each subsequent fold line is scored or creased on opposite sides of the side wall. For example a first fold line may be scored or creased on an outer surface of the side wall, a second adjacent fold line may be scored or creased on an inner surface of the side wall, and a third fold line adjacent to the second fold line may be scored or creased on an outer surface of the side wall, and so on. Those fold lines scored or creased on the outer surface of the side wall may form a nadir of an indent of the side wall as the container is collapsed.

The indents preferably form a "V" shaped profile when viewed from the top. The side walls may have an accordion or bellows type structure.

The indents may be present in the expanded configuration or may only occur as the container is collapsed.

The bottom may include one or more fold lines. The fold lines of the bottom may be aligned with and extend to the fold lines of the side walls. The bottom may have three or more fold lines that form two or more indents that are aligned with and extend to the indents of the side walls.

The container may include one or more panels in the interior to divide the interior into compartments. The compartments may be sealed by the manufacturer, or not. The panels may be sealable relative to an inner surface of, for example the front wall or the back wall, or to one other to from sealed compartments. If sealed by a manufacture, the seal may be formed in any suitable manner such as heat sealing, cold sealing, ultrasonic sealing or the like. The container may include a tear strip or other suitable feature to allow the consumer to readily break the seal to access the contents of the compartment.

Preferably, the compartments are resealable. The container may include a compartment sealing element to seal or reseal a compartment. Any suitable compartment sealing element may be used. Examples of suitable compartment sealing elements include the sealing elements discussed above regarding the sealing elements in the region of the fin. For example, a compartment sealing element may include a pressure sensitive adhesive, a microsuction structure, a zip sealing assembly, magnetic and opposing magnetic material, or the like. Preferably, the compartment sealing element prevents material, such as tobacco, stored in the sealed compartment from accidentally spilling out of the compartment.

Tobacco material having different flavors or different blends may be stored within separate sealed compartments in the container. Preferably, the compartments are sealed sufficiently to prevent flavor or other volatile compounds from exiting one sealed compartment and entering another sealed compartment. Thus, the flavor of the tobacco material in each sealed compartment may be maintained without substantial dilution or contamination.

Alternatively, substantially similar tobacco material may be stored in separate sealed compartments. A consumer may use tobacco material stored in one compartment until it is depleted while maintaining the seal in another compartment to maintain the freshness of the tobacco material in the other compartment until use.

The panels may extend from the bottom and the side walls. The panels may extend from the indents of the side walls and, if present, the indents of the bottom.

Containers of the invention may include any suitable number of compartments. For example, the containers may have 2 or more compartments, 3 or more compartments, 4 or more compartments, or 5 or more compartments. Preferably, at least one compartment contains tobacco material and at least one compartment contains a tobacco accessory such as cigarette paper. Preferably the compartment that contains the tobacco accessory does not contain tobacco material or is free of tobacco material.

The compartment may have any suitable size that defines any suitable volume. The size and volume of any two or more compartments may be the same or different. For example, a compartment for storing tobacco material may define a first volume and a compartment for storing a tobacco accessory may define a second volume that is at least about 10% less than or at least about 20% less than or at least about 30% less than the first volume. In some embodiments, the tobacco material compartment may define a first volume and the tobacco accessory may define a second volume that is at least about 10% greater than or at least about 20% greater than or at least about 30% greater than the first volume.

The containers of the invention may be made of any suitable material or materials. Preferably, the front wall, the back wall, the side walls, the top and the bottom are made from the same one or more materials. In some preferred embodiments, the front wall, the back wall, the side walls, the top and the bottom are made formed of a flexible substrate material from a sheet of material. The sheet may be formed of any flexible material or combination of materials. In some embodiments, the material or materials are capable of being heat-sealed to form a permanent seal that may be airtight. Preferably, the material or materials have sufficient moisture barrier properties to prevent loss of moisture from consumer goods, such as tobacco or smokable material, during storage or use and to prevent the ingress of water or vapor into or out of the container or compartments. In addition, the material or materials forming the front wall, the back wall, the side walls, the top and the bottom are preferably impermeable to microorganisms. The container may have regions that are transparent or opaque or may be metallized or may be entirely transparent or opaque or may be entirely metallized.

The panels, if present, may be formed from the same material or materials as the front wall, the back wall, the side walls, the top and the bottom or may be formed from different material or materials from the front wall, the back wall, the side walls, the top and the bottom. Preferably, the material or materials forming the panels are the same as the material or materials forming the front wall, the back wall, the side walls, the top and the bottom.

The front wall, the back wall, the side walls, the top and the bottom may be formed from a single layer material, or a laminate material, for example a metal and plastic laminate. Suitable materials include single layer materials like polyolefins such as polyesters, in particular, polyethylene, polypropylene, polyethylene terephthalate (PET), linear low-density polyethylene (LLDPE), high-density polyethylene (HDPE), ultra high-density polyethylene (UHDPE), orientated polypropylene (OPP), cast polypropylene (CPP), for example.

Other embodiments include multiple layer laminates, preferably double or triple layer laminates. The multilayer laminates preferably include at least one layer of polyethylene, metalized polyethylene, polyethylene terephthalate or metalized polyethylene terephthalate and other suitable laminates, e.g. cellulose-based laminates with limited water-vapour permeability. The water-vapour permeability is measured by the vapour-water transmission rate in accordance with ISO 2528: 1995. In a preferred embodiment, the vapor-water transmission rate is measured at 25 degrees Celsius and 60 percent relative humidity.

In a preferred embodiment, the vapor-water transmission rate is less than about 20 grams per square meter per 24 hours, preferably less than about 15 grams per square meter per 24 hours, further preferred less than about 10 grams per square meter per 24 hours, even more preferably less than about 8 grams per square meter per 24 hours, most preferably less than 15 about 6 grams per square meter per 24 hours.

Preferably the front wall, the back wall, the side walls, the top and the bottom are formed from a multiple layer laminate, preferably double or triple layer laminates. The multilayer laminates preferably include at least one layer of polyolefin such as, polyethylene, metalized polyethylene, polyethylene terephthalate or metalized polyethylene terephthalate or other suitable laminates, e.g. cellulose-based laminates with limited water-vapour permeability. Preferably heat sealing forms a hermetic seal.

Examples of two layer laminate sheet material includes independently selecting two layers of the following materials: polyethylene, polypropylene, polyethylene terephthalate (PET), orientated polypropylene (OPP), cast polypropylene (CPP), metallized cast polypropylene (Met CPP), and metallized polyethylene (Met PE) for example.

Examples of three layer laminate sheet material includes independently selecting three layers of the following materials: polyethylene, polypropylene, polyethylene terephthalate (PET), metallized polyethylene terephthalate (Met PET), orientated polypropylene (OPP), cast polypropylene (CPP), metallized cast polypropylene (Met CPP), and metallized polyethylene (Met PE) for example.

In some preferred embodiments the front wall, the back wall, the side walls, the top and the bottom are formed of a laminate sheet material formed of a layer of orientated polypropylene (OPP), polyethylene terephthalate (PET) optionally metallized polyethylene terephthalate (Met PET), and polyethylene.

In some embodiments the multi-compartment tobacco pouch is formed of PET having a sheet thickness in a range from about 10 microns to about 50 microns. One example of a suitable three-layer laminated sheet material for forming the pouch comprises a first layer of about 40 grams per square meter of paper, a second layer of metallized about 12 micron thick PET, and a third layer of about 60 micron thick low density polyethylene.

In preferred embodiments, a container of the invention is a stand up bag.

The containers of the invention are suitable for storing any consumer good or goods.

In some preferred embodiments, packaged products include containers of the invention and tobacco material in the interior of the container. The containers or compartments of containers of the invention may be suitable for storing a wide variety of tobacco or smokable materials, including one or more tobacco types. The tobacco material may be in any suitable form and may include tobacco cut from tobacco leaves, reconstituted tobacco material, or both. The tobacco material typically has a cut width of between about 0.1 and about 0.9 millimetres, more preferably between about 0.3 and about 0.6 millimetres and may be pasteurized.

Preferably, the moisture content of the tobacco material within the pouch is between about 15 percent and about 22 percent by weight, more preferably between about 16 percent and about 20 percent by weight as measured two weeks after the filling of the multi-compartment tobacco pouch with the tobacco material. The amount of tobacco material in the tobacco compartment preferably has a weight of between about 10 grams and about 500 grams, more preferably between about 20 grams and about 60 grams.

When two or more tobacco compartments are present in a multi-compartment container, each tobacco compartment may contain the same or same type or same blend of tobacco, or each tobacco compartments may contain a different or a different type or different blend of tobacco. Each tobacco compartments may contain the same amount or tobacco, or a different amount of tobacco.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

The schematic drawings are not necessarily to scale and are presented for purposes of illustration and not limitation. The drawings depict one or more aspects described in this disclosure. However, it will be understood that other aspects not depicted in the drawing fall within the scope and spirit of this disclosure. Referring now to the drawings, in which some aspects of the present invention are illustrated.

Figure 1:
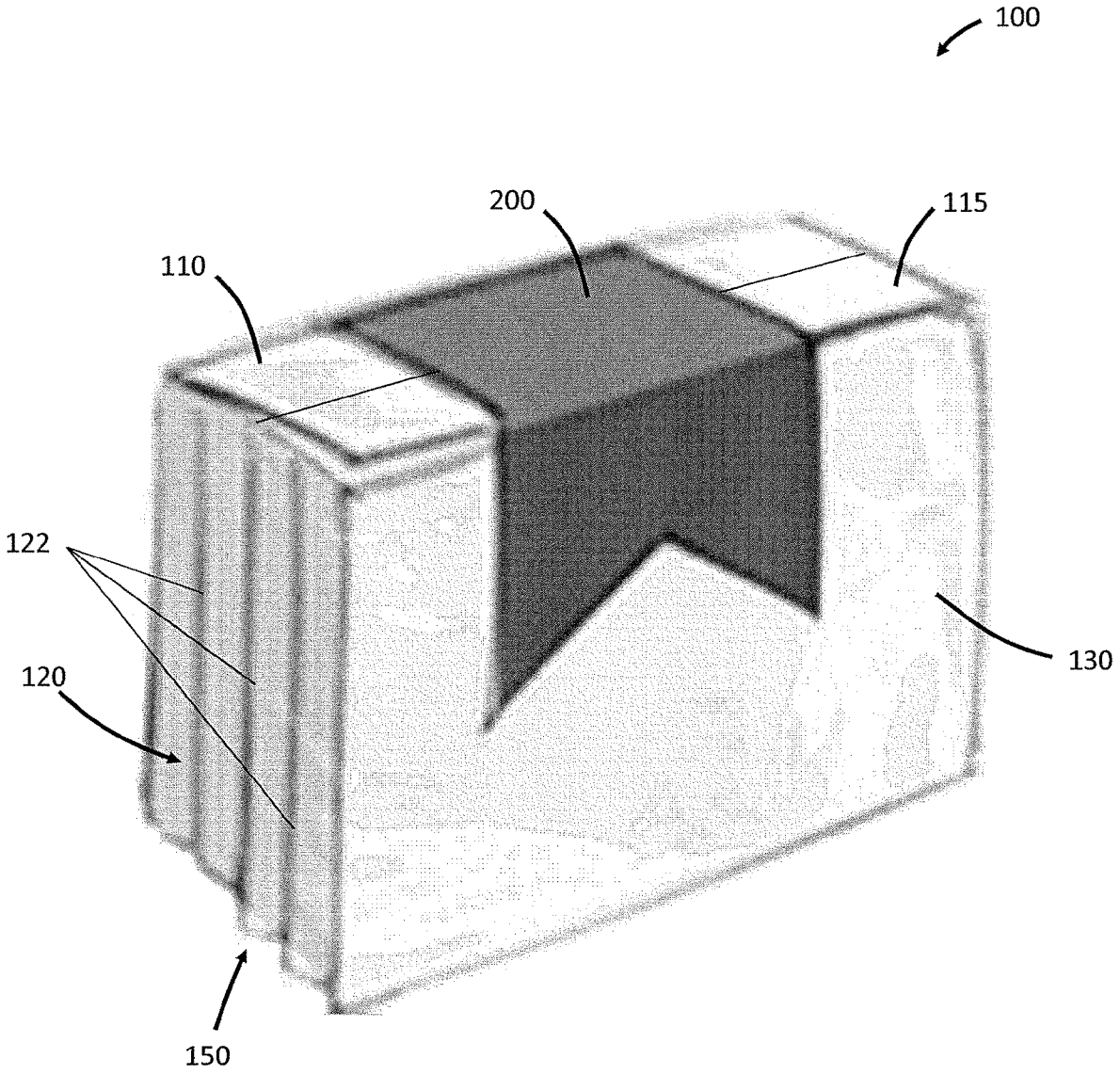
FIG. 1 is a schematic perspective view of an embodiment of a container with the top folded down.
Figure 2:
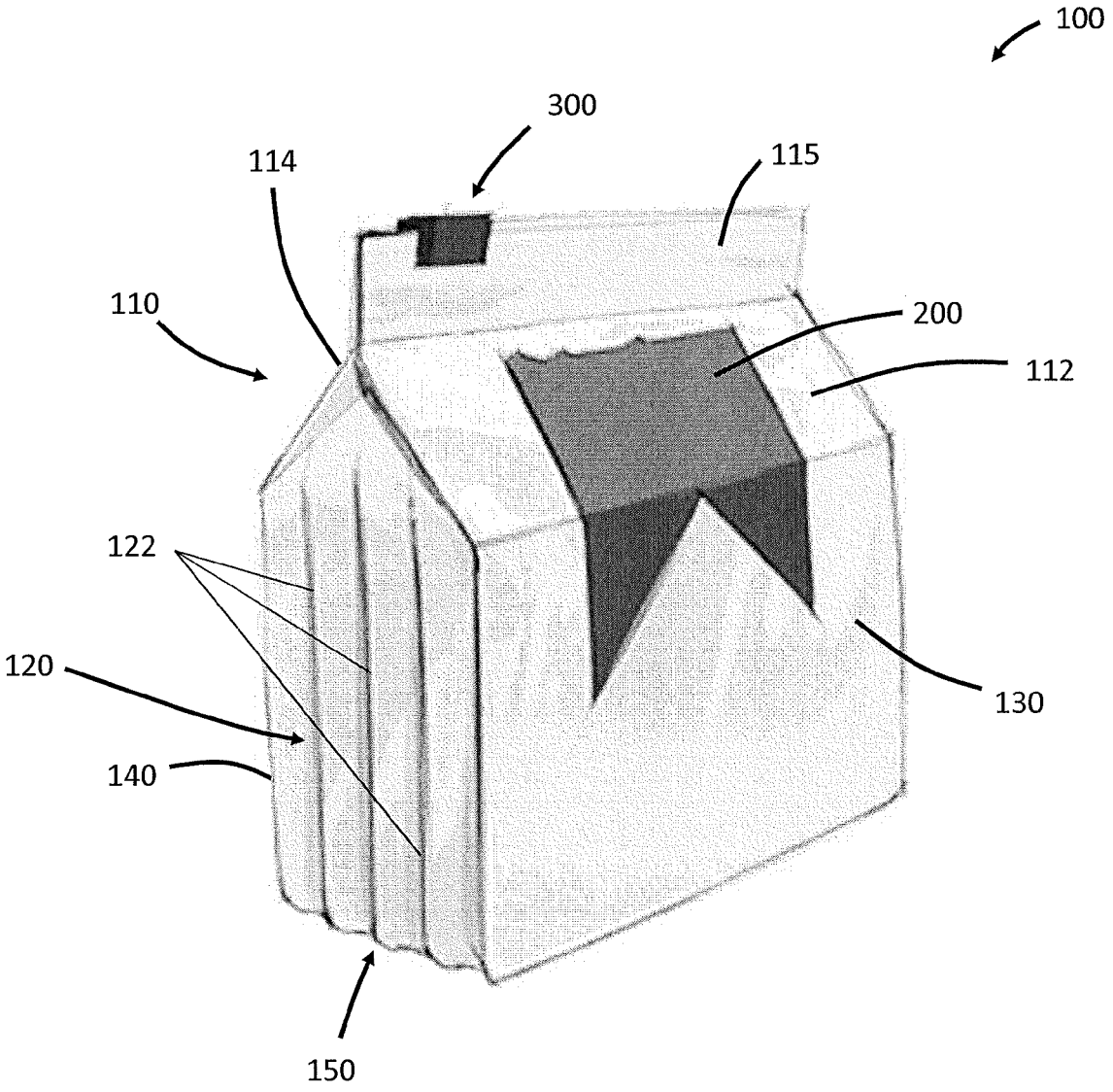
FIG. 2 is a schematic perspective view of an embodiment of a container depicted in FIG. 1 with the top unfolded.

Referring now to FIGS. 1-2, the depicted container 100 includes a front wall 130, a back wall 140, a first side wall 120, a second side wall (not shown in FIGS. 1-2), a bottom 150, and a foldable top 110. The first side wall 120 and second side wall each comprise three aligned fold lines 122 that cooperate to form at least two indents when the container 100 is collapsed. The bottom 150 may also include three fold lines that extend from the fold lines 122 of the first side wall 120 and the fold lines of the second side wall. The contiguous folds may facilitate structured collapsing of the container 100. The container 100 may be a stand-up bag. The fold lines may provide structural support to allow the bag to stand upright on the bottom 150.

The top 110 of the container 100 in FIG. 1 is folded down. A label 200 retains the top 110 in the folded configuration. The label 200 may be affixed by a manufacturer. The label 200 may be attached to the front wall 130 and the back wall 140 and extend over the top 110 to keep the top 110 folded down. If the label 200 is unbroken as in FIG. 1, a consumer can be assured that the contents of the package have not been tampered with. The container 100 sealed by a manufacturer with the label 200 may have a substantially rectangular shape, which can allow for efficient packing for shipping and easy storage prior to use by a consumer. Width of the container 100 (distance from front wall 130 to back wall 140) along the entire height (distance from bottom 150 to top 110) of the container 100 is substantially the same.

The container 100 in FIG. 1 may be filled with consumer goods by the manufacturer prior to affixing the label 200, which may help maintain the container 100 in an expanded configuration.

In FIG. 2, label 200 is broken and the top 110 is unfolded revealing a first face 112 and a second face 114 of the top 110. The first face 112 extends from the top of the front wall 130. A fold line demarcates the front wall 130 from the first face 112 of the top 110. The second face 114 extends from the top of the back wall 140. A fold line demarcates the second face 114 from the back wall 140. The first face 112 and the second face 114 together form a fin 115. The container 100 includes a sealing element 300 in the region of the fin 115. The sealing element 300 depicted in FIG. 2 is a plastic zip sealing assembly, such as a Zip-Lock seal. The sealing element 300 may be opened and the first 112 and second 114 face of the top in the region of the fin 115 may be separated to allow a consumer access to the contents of the bag.

Figure 3:
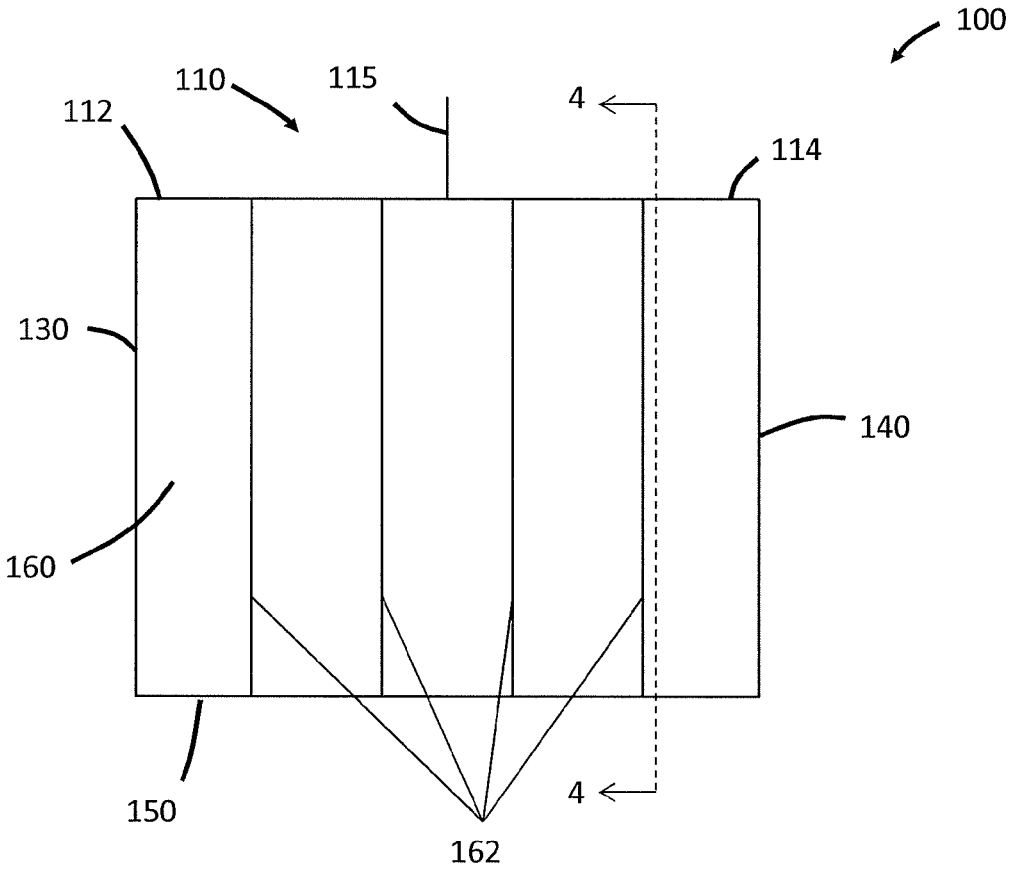
FIG. 3 is a schematic side view of an embodiment of a fully expanded container with the top unfolded.

Referring now to FIG. 3 the container 100 is shown in a fully expanded unfolded position. The container 100 includes four fold lines 162 on the second side wall 160 that extend from the top 110 to the bottom 150 of the container. The container 100 also includes four aligned fold lines on the first side wall 120. The container may also include four fold lines on the bottom 150 that extend from the fold lines of the first side wall 120 to the fold lines 162 of the second side wall 160. The length of the first face 112 of the top (from the front wall 130 to the fin 115) is the same as the length from the second face 114 (from the back wall 140 to the fin 115). The sum of the length of the portion of the first face 112 extending from the front wall to the fin and the length of the portion of the second face 114 extending from the rear wall to the fin is equal to the width of the bottom 150 (from the front wall 130 to the back wall 140) when the bag is expanded.

Figure 4:
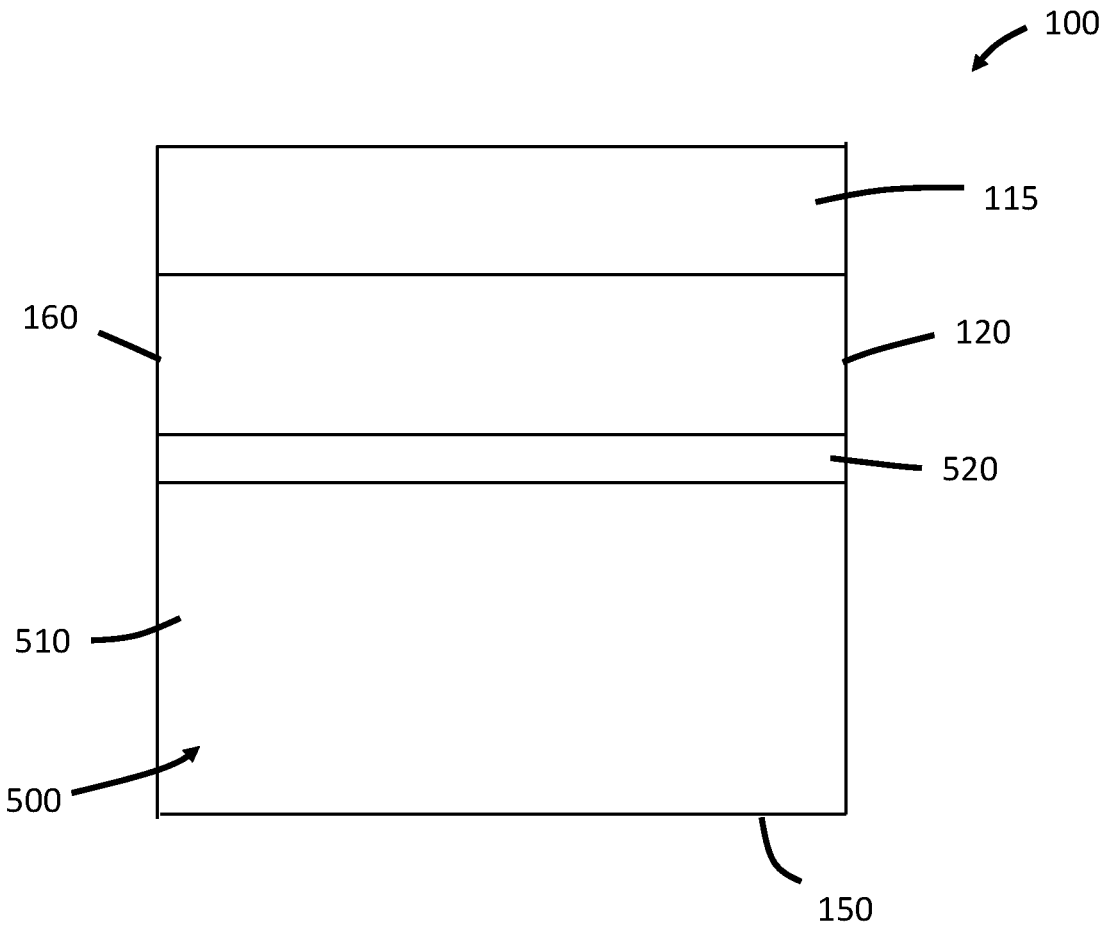
FIG. 4 is a schematic sectional view along line 4-4 of an embodiment of a container depicted in FIG. 3. The drawing in FIG. 4 should not be considered to be to scale.

As shown in FIG. 4, one or more panel 510 may be disposed in the interior of the container 100. The panels 510 extend from side walls 120, 160 and the bottom 150. Two or more panels 510 may form a compartment 500 within the interior of the container 100. Alternatively, a panel 510 and at least a portion of the front or back walls may form a compartment 500. The container 100 depicted in FIG. 4 includes a compartment sealing element 520, which may be resealable.

The specific embodiments described above are intended to illustrate the invention. However, other embodiments may be made without departing from the spirit and scope of the invention as defined in the claims, and it is to be understood that the specific embodiments described above are not intended to be limiting.

The invention claimed is:

1. A stand-up bag for consumer goods comprising:

a front wall;

a back wall;

first and second opposing sidewalls;

a foldable top; and a bottom, wherein an interior for storing the consumer goods is defined between the front wall, the back wall, the first and second side walls, the top and the bottom, wherein each side wall comprises three or more fold lines, which form two or more indents extending along the side wall from the bottom to the top and wherein the fold lines of the first side wall are aligned with the fold lines of the second side wall such that the side walls form an accordion or bellows type structure, wherein the fold lines of the first and second side walls provide sufficient rigidity to allow the bag to stand upright, wherein the bag is expandable and collapsible such that the distance between the front wall and the back wall increases as the bag is expanded and decreases as the bag is collapsed, and wherein the top forms a fin when the top is unfolded, wherein the top comprises a first face extending from the front wall and a second face extending from the back wall, wherein a portion of an inner surface of the first face and a portion of an inner surface of the second face contact to form the fin, and wherein when the top is folded down, the first and second faces of the top are substantially parallel to the bottom and the fin is substantially flat against one of the first face or the second face of the top; and wherein when the top is folded down and the bag is expanded, the bag has a rectangular box shape.

2. A bag according to claim 1, wherein when the bag is fully expanded, a portion of the first face of the top that extends from the front wall to the fin and a portion of the second face of the top that extends from the back wall to the fin lie within a plane substantially parallel to the bottom of the bag.

3. A bag according to claim 2, wherein the first and second faces of the top, in a region of forming the fin, are separatable to provide access to the interior of the bag.

4. A bag according to claim 1, further comprising a sealing element configured to seal the bag in the region of the fin, wherein the sealing element is resealable.

5. A bag according to claim 4, wherein the sealing element comprises a zip sealing assembly.

6. A bag according to claim 1, wherein the bag further comprises one or more panels disposed in the interior and dividing the interior into compartments.

7. A bag according to claim 6, wherein the one or more panels are extended from the bottom, the first side wall, and the second side wall.

8. A bag according to claim 7, wherein the one or more panels comprise at least a first panel, wherein at least a portion of the first panel is sealable to at least a portion of a second panel, the front wall, or the back wall to form a sealed compartment.

9. A bag according to claim 8, wherein the compartment comprises a compartment sealing element, and wherein the compartment sealing element is resealable.

10. A bag according to claim 1, wherein the bottom comprises three or more fold lines, which form two or more indents aligned with and extending to the indents of the first and second side walls.

11. A bag according to claim 1, wherein the fold lines of the first and second side walls are configured to allow the bag to stand upright on the bottom.

12. A bag according to claim 1, where the bag further comprises a resealable label to maintain the top folded down prior to unfolding by a consumer.

13. A bag according to claim 12, wherein the label is configured to act as an evidence of tampering by being broken when the consumer unfolds the fin on the top for the first time.

14. A bag according to claim 1, wherein the consumer goods comprises a tobacco related products.

* * * * *